US005326221A

United States Patent [19]

Amyot et al.

[11] Patent Number: 5,326,221

[45] Date of Patent: Jul. 5, 1994

[54] OVER-CAMBERED STAGE DESIGN FOR STEAM TURBINES

[75] Inventors: Joseph W. Amyot, Rexford; Stephen G. Ruggles, Scotia; Philip F. Berrahou, Cohoes, all of N.Y.; Robert J. Orlando, West Chester, Ohio

[73] Assignee: General Electric Company, Schenectady, N.Y.

[21] Appl. No.: 112,365

[22] Filed: Aug. 27, 1993

[51] Int. Cl.[5] ..... F01D 9/02; F01D 5/14

[52] U.S. Cl. ..... 415/191; 415/181; 416/223 A

[58] Field of Search ..... 416/223 A; 415/181, 415/191

[56] References Cited

U.S. PATENT DOCUMENTS

| | | | |
|---|---|---|---|
| 2,795,373 | 6/1957 | Hewson | 415/181 |
| 3,953,148 | 4/1976 | Seippel et al. | 415/181 |
| 4,208,167 | 6/1980 | Yasugahira et al. | 415/191 |
| 4,616,975 | 10/1986 | Duncan | 415/181 |
| 4,696,621 | 9/1987 | Hamblett et al. | 415/191 |
| 4,741,667 | 5/1988 | Price et al. | 415/181 |

*Primary Examiner*—Edward K. Look
*Assistant Examiner*—James A. Larson
*Attorney, Agent, or Firm*—Nixon & Vanderhye

[57] ABSTRACT

Steam turbine nozzle blades and buckets are profiled in accordance with Tables I and II or multiples of the X,Y and R coordinates of the charts. The profiles of the nozzle blades impose a parabolic flow distribution at the throat and the buckets accommodate the incoming flow. The nozzle blades and buckets are over-cambered at their roots and tips to constrict flow from the roots and tips into the mid-regions of the blades and buckets. Improved aerodynamic efficiencies are obtained by directing the flow away from the end walls of the blades and buckets toward the efficient mid-region of the blades and buckets whereby flow velocity and angle leaving the nozzle has a non-linear distribution and the bucket velocity leaving angles are similarly non-linear.

7 Claims, 5 Drawing Sheets

OVER-CAMBERED STAGE DESIGN FOR STEAM TURBINES

TECHNICAL FIELD

The present invention relates to turbines, specifically steam turbines, and particularly relates to steam turbine nozzle and bucket designs having improved aerodynamic efficiency.

BACKGROUND

Nozzle and bucket stages for steam turbines have for some time been the subject of substantial developmental work. This is because the efficiency of the power plant cycle is largely dependent on the efficiency of the energy conversion in the turbine. Thus, in is highly desirable to optimize the performance of steam turbine nozzles and buckets to improve aerodynamic efficiency, particularly by minimizing aerodynamic and steam leakage losses. In a typical nozzle design, there is a substantially linear distribution of the flow velocity leaving the nozzle exit. The nozzle leaving angle is the angle between the flow angle and a plane normal to the machine or turbine axis. This angle typically changes in a linear manner from the root to the tip, for example, on the order of 12° to 15°. In a typical bucket design, the total velocity at the bucket exit is substantially constant, i.e., there is no flow shifting from root to tip, or vice-versa. Additionally, the bucket leaving angle Δ i.e., the angle at which flow exits the bucket relative co the axis of the machine or turbine, is substantially fairly constant from tip to root for a typical stage having a free vortex design.

Present nozzle designs typically include a large number of nozzles to avoid excitation of bucket resonant modes. Because of the high nozzle count, nozzle blades having extended noses for structural strength purposes are often provided. This is turn results in efficiency-lowering high surface friction forces. A lower solidity nozzle is thus desirable to increase turbine stage performance.

While these characteristics of nozzle and bucket designs as described are quite efficient aerodynamically, the present invention provides still further improved aerodynamic efficiencies, improving the overall performance of the turbine.

DISCLOSURE OF THE INVENTION

In accordance with the present invention, end wall or secondary losses at the nozzle are substantially reduced by imposing a parabolic throat distribution on the nozzle. The bucket is then designed to accommodate or match the incoming flow properties. More particularly, the present invention minimizes the flow of steam through the area of the nozzles adjacent the end walls at the tip and root and biases the flow toward the more aerodynamically efficient mid-section of the nozzle blade. By increasing the steam flow through the more aerodynamically efficient areas of the nozzle and reducing the steam flow through the relatively less efficient areas of the nozzle, i.e., adjacent the root and tip end walls, improved aerodynamic efficiencies are provided in both the nozzle and bucket. Stated differently, the nozzle and bucket blades are over-cambered in the root and tip areas of the blades defining a flow passage more constricted at the tip and root of the blades and more open in the mid-regions of the blades. This tends to drive the flow away from the end walls and toward the center of the nozzles which is in the more aerodynamically efficient region. Additionally, a more pronounced swirl occurs as a result, which swirl can then be utilized in a succeeding stage.

The foregoing is accomplished by particular profiles of the blades of the nozzles and buckets. The blades are shaped to provide a nozzle throat generally parabolic to direct the flow toward the aerodynamically efficient center portions of the nozzle and bucket and away from the lesser efficient portions at the root and tips. This parabolic design results in a nozzle flow leaving angle distribution which is non-linear. For example, the angle may change from 10° to about 16° or 17° adjacent the mid-region of the nozzle and return to approximately 11° or 12° at the tip, both in curvilinear fashion to shift the flow to the mid-region of the nozzle. Relative angle velocity and distributions at the bucket exit is likewise non-linear radially of the buckets.

To further improve stage efficiency, a low solidity nozzle. design is provided. Surface friction is reduced by a low blade count which is designed to provide excitation between the resonant natural frequencies of the buckets while providing for adequate strength.

In a preferred embodiment according to the present invention, there is provided a nozzle for a steam turbine having a blade profile in accordance with Table I.

In a further preferred embodiment according to the present invention, there is provided a nozzle for a steam turbine having nozzle blade profiles in accordance with Table I scaled by multiplying X, Y and R coordinates thereof by a predetermined number.

In a still further preferred embodiment according to the present invention, there is provided a bucket for a steam turbine having a bucket profile in accordance with Table II.

In a still further preferred embodiment according to the present invention, there is provided a steam turbine having a bucket profile in accordance with Table II scaled by multiplying X,Y and R coordinates thereof by a predetermined manner.

In a still further preferred embodiment according to the present invention, there is provided a nozzle for a steam turbine having a pair of adjacent blades having leading and trailing edges, blade bodies therebetween, and root and tip portions with a mid-region therebetween, said adjacent blades defining a throat therebetween measured by a series of straight lines extending from the trailing edge of a blade to the closest adjacent surface along the body of the adjacent blade and defining a pitch in the circumferential spacing between blades, the ratios off the throat to the pitch at successive profiles along said blades increasing from the root portions toward a mid-blade region and then decreasing from the mid-blade region to the tip portion, the blades being one of nozzle or bucket blades.

Accordingly, it is a primary object of the present invention to provide a novel and improved over-cambered and reduced solidity stage design for nozzles and buckets of a steam turbine affording improved aerodynamic efficiencies.

BEST MODE FOR CARRYING OUT THE INVENTION

Reference will now be made in detail to a present preferred embodiment of the invention, an example of which is illustrated in the accompanying drawings.

Figure 1:
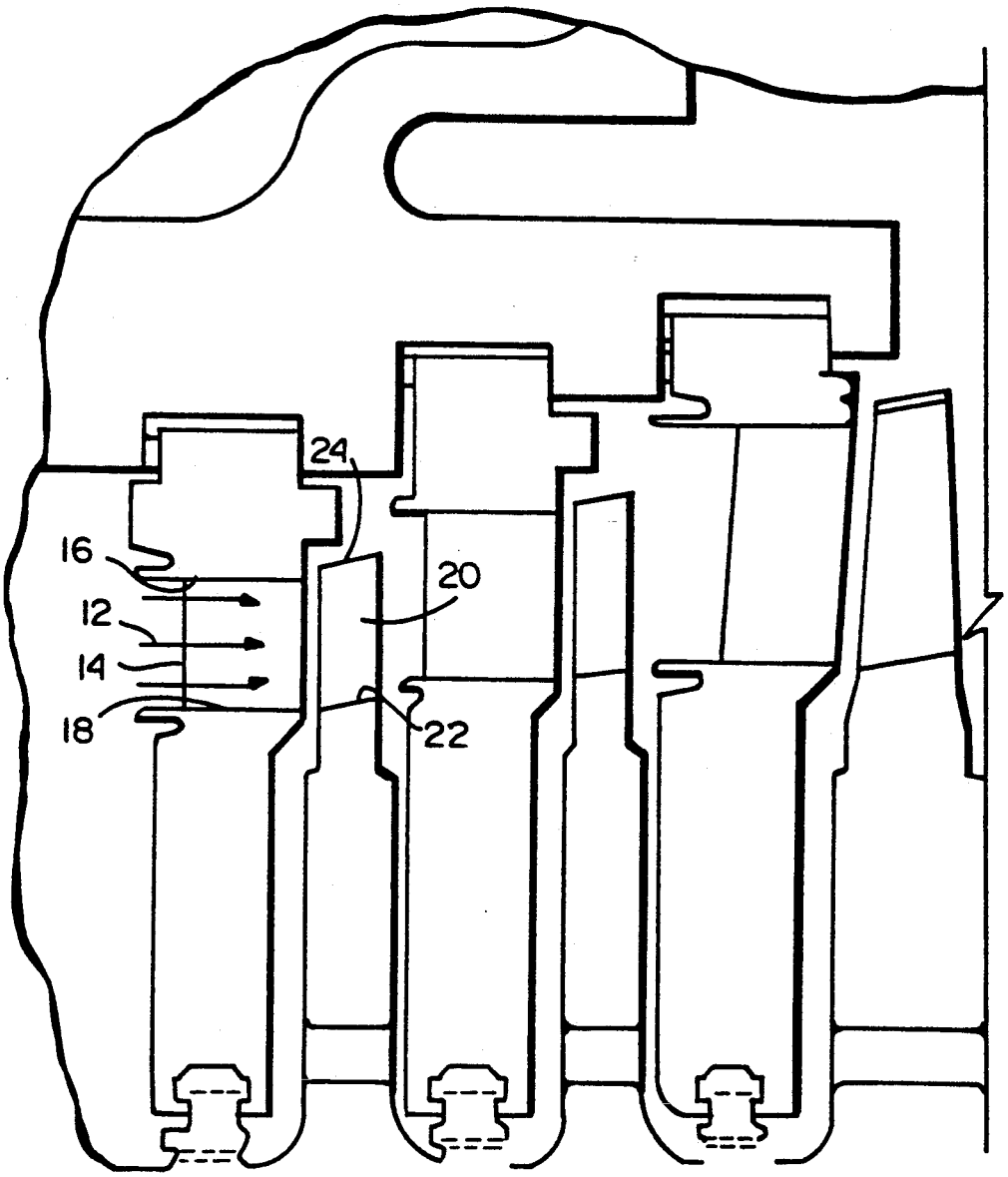
FIG. 1 is a schematic representation of a steam turbine nozzle and bucket assembly.

Referring now to the drawings, particularly to FIG. 1, there is illustrated a stage in a stream turbine including a stationary nozzle 12 comprised of a plurality of nozzle blades 14, fixed between inner and outer end walls 18 and 16, respectively, for flowing fluid, for example, steam, in an axial direction and driving the rotatable turbine buckets 20. As will be appreciated, turbine buckets 20 are connected and drive a rotor, not shown, of the turbine. Buckets 20 extend between inner and outer walls 22 and 24, similarly as the nozzle blades 14.

Also illustrated in FIG. 1 is a flow pattern illustrated by the arrows, indicating the direction of flow of the fluid through the nozzle when the over-cambered stage design of the present invention is used in the turbine. Thus, it will be seen that in accordance with the particular blade profiles of the present invention, the flow is directed from the blade root radially outwardly toward the mid-portion of the nozzle and from the blade tip radially inwardly toward the more efficient mid-portion of the nozzle. As a consequence of the flow pattern achieved by the profiles of the nozzle blades 14, a parabolic throat distribution is provided wherein the nozzle leaving angle is non-linear extending, for example, from approximately 10° at the root to 16° or 17° about the mid-portion of the nozzle and returning to an 11° or 12° angle at the tip. The buckets are designed to match and accommodate the flow which is now constricted toward the mid-region of the nozzle such that the angle and velocity distributions at the bucket exit are likewise non-linear.

Figure 2:
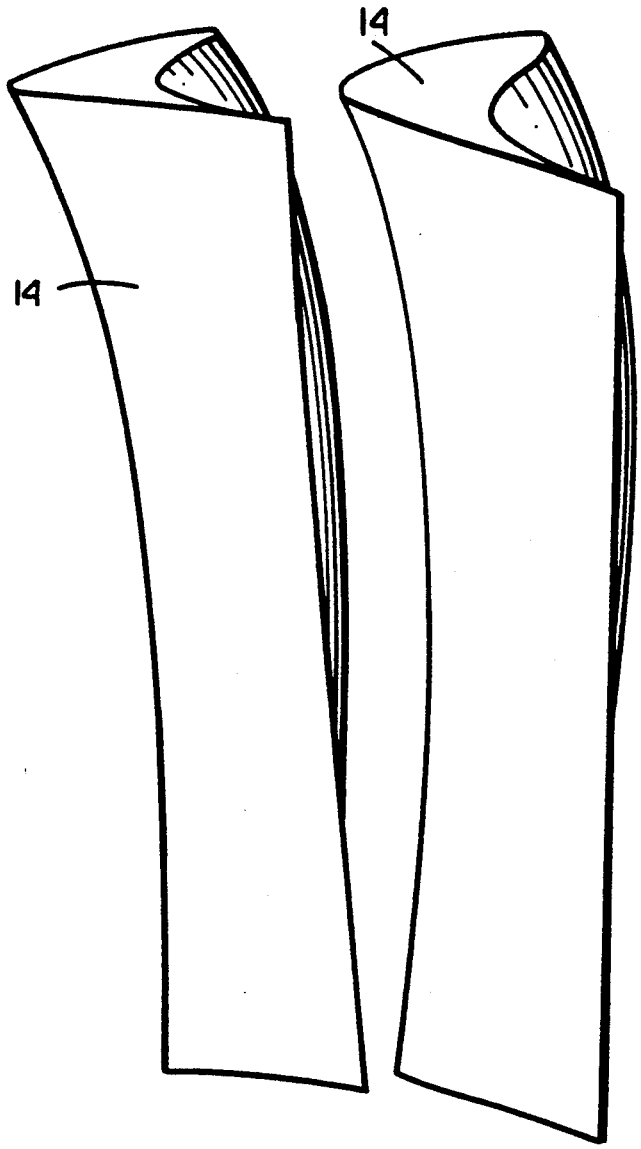
FIG. 2 is an illustration of a pair of adjacent nozzle blades illustrating the profile of the blades.

A pair of the adjacent nozzle blades of this invention are illustrated in FIG. 2. From a review of FIG. 2, it will be seen that the throat areas of the nozzle adjacent the tip and root are constricted, while the mid-throat region is enlarged. Hence, the flow through the nozzle throat is biased toward the mid-region of the blades.

The throat distance S between adjacent nozzle blades is essentially defined by the distance from the trailing edge of one blade to the closest adjacent surface of the adjacent blade. Looking into the throat region from the trailing edge of the nozzle blades, it will be appreciated that the throat has a maximum width in a region 40–60% of the blade length from the root. The minimum throat areas are located at the roots and tips of the adjacent blades.

Figure 3:
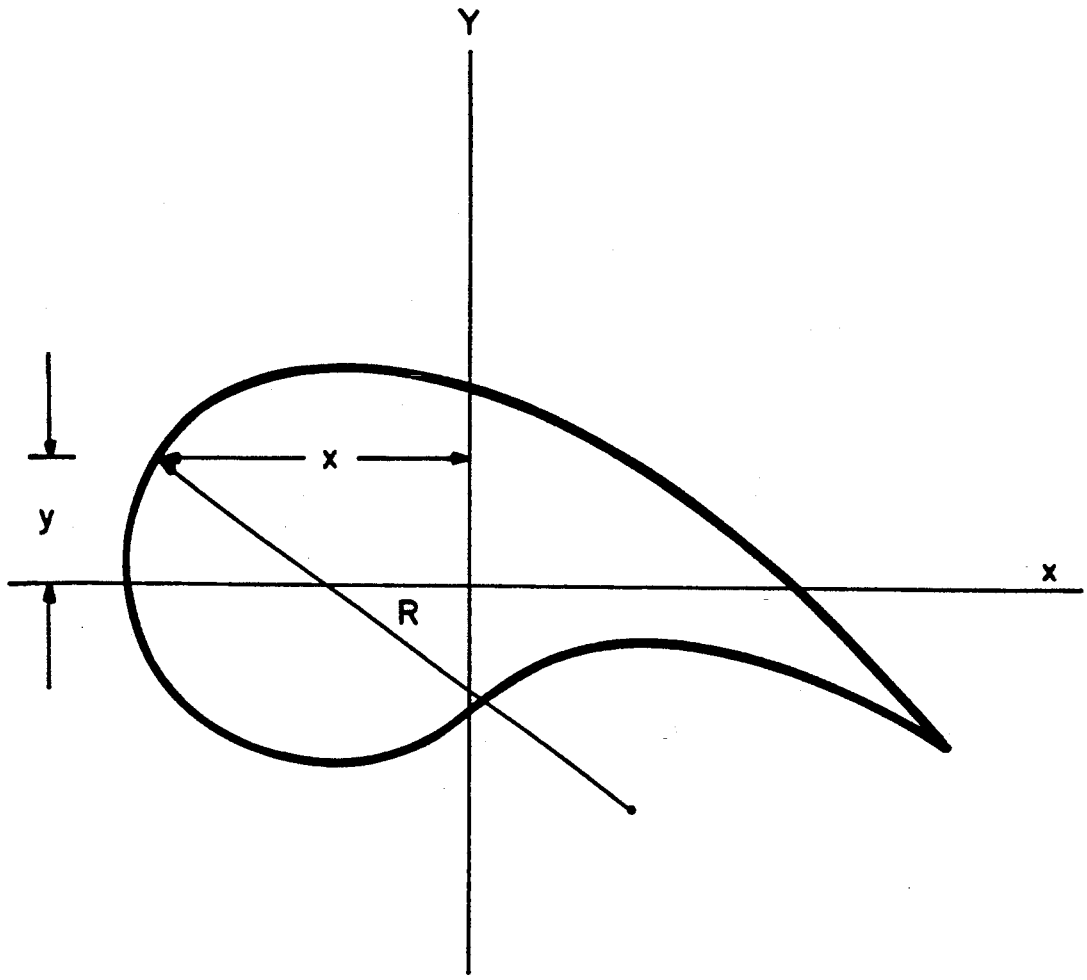
FIG. 3 is a graph illustrating a representative air foil section of the nozzle profile as defined by the charts of the following specification.
Figure 4A:
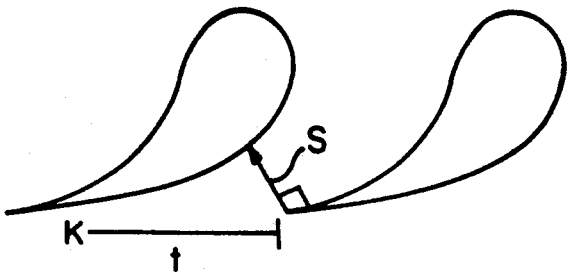
FIG. 4A is a schematic cross-section of adjacent blades of a turbine illustrating their profiles and the throat and pitch distances.
Figure 4B:
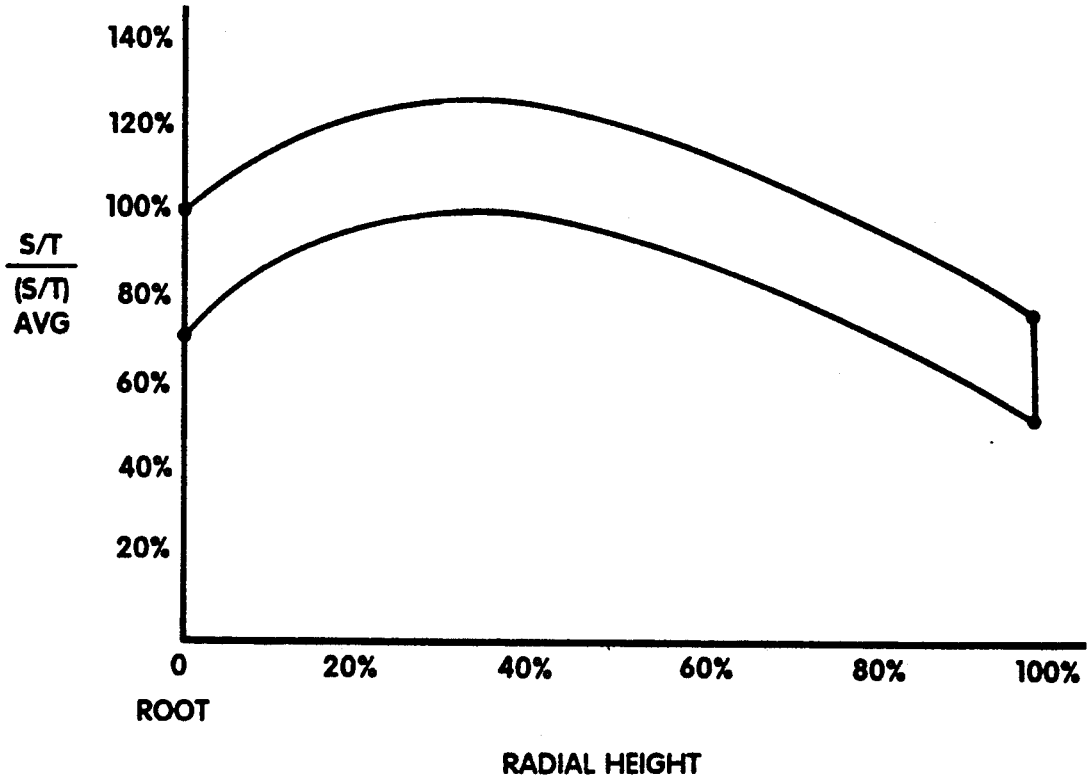
FIGS. 4B and 4C are graphs representing the throat/-pitch ratios versus blade height from the root for the nozzles and buckets, hereof respectively.
Figure 4C:
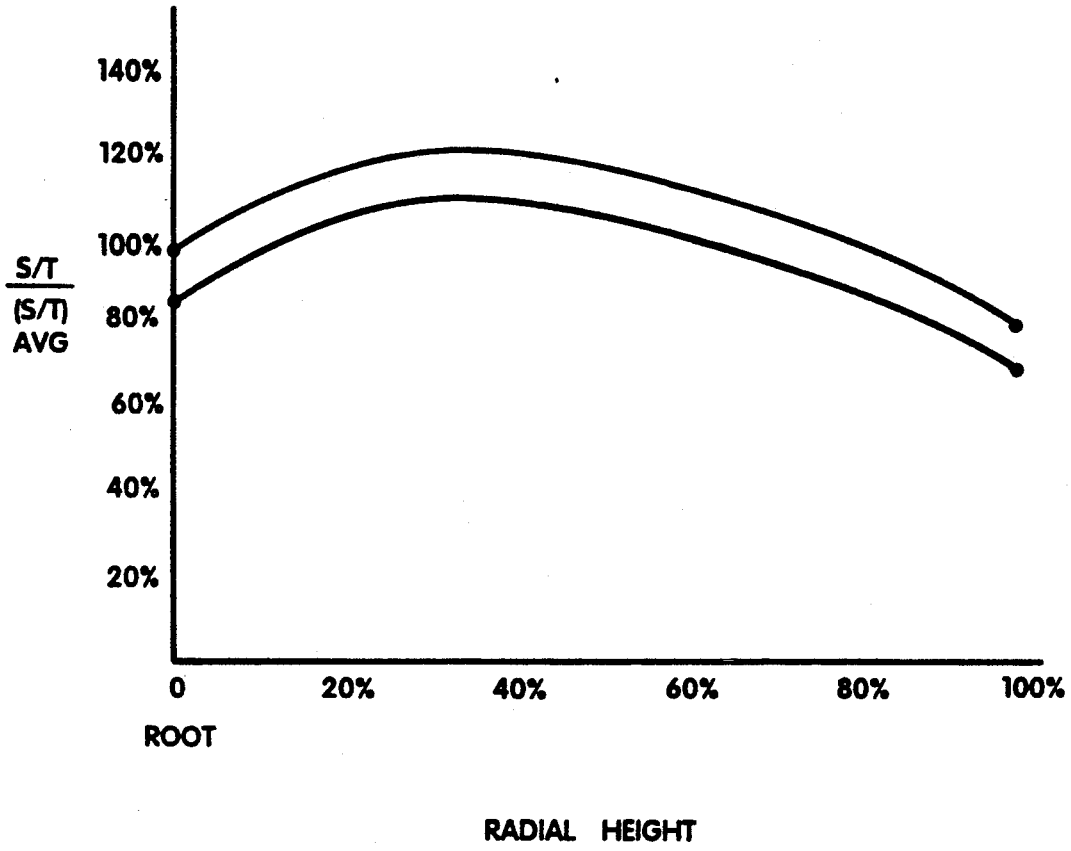

To more clearly illustrate the throat design, reference is made to FIGS. 4A, 4B and 4C, wherein the throat S in relation to the pitch T is illustrated. The pitch T is the circumferential distance between the trailing edges of adjacent blades at a specified radial distance from the blade root. In FIG. 4B, a generalization of the ratio of the nozzle S/T distribution to the average nozzle S/T distribution is plotted along the ordinate against the radial height of the blade plotted along the abscissa. FIG. 4C represents the same generalization with respect to the bucket S/T distribution versus the radial height of the blade. Thus, a nozzle S/T distribution has the following representative characteristics:

(1) Maximum S/T occurs at about 30%–60% of the radial height
(2) Maxime S/T is 110–125% of the average S/T
(3) Root S/T is 70%–100% of the average S/T
(4) Tip S/T is 55%–85% of the average S/T A bucket S/T distribution has the following representative characteristics:

(1) Maximum S/T occurs at about 30%–50% of the radial height
(2) Maximum S/T is 110%–120% of the average S/T
(3) Root S/T is 85%–95% of the average S/T
(4) Tip S/T is 70%–80% of the average S/T Referring now to FIG. 3, there is illustrated a representative nozzle blade profile at a predetermined radial distance from the root section. This radial distance is taken from a datum line at the intersection of the blade root section and the inner end wall 18 and is given as a fraction of the total length of the blade from root to tip. Each profile section at that radial distance is defined in X, Y coordinates by adjacent points connected one tangent to the other along the arcs of circles having radii R. The arc connecting the points defined by the adjacent X,Y components constitutes a portion of a circle having a radius R extending from a center. Values of the X,Y coordinates and the radii R for each blade section profile taken at specific fractions of the blade length from the root section of the blade are tabulated in the following Tables I and II. The tables identify the various points along a profile section at the given radial distance from the root section by their X,Y coordinates and it will be seen that the tables have a range of representative X,Y coordinate points, depending upon the profile section height from the root. These values are given in inches and represent the actual blade profile at ambient non-operating conditions. The value for each radius R provides the length of the radius defining the arc of the circle between two of the adjacent points identified by the X,Y coordinates. The sign convention assigns a positive value to the radius R when the adjacent two points are connected in a clockwise direction and a negative value to the radius R when the adjacent two points are connected in a counterclockwise direction. By providing X,Y coordinates for spaced points about the blade profile at selected radial positions or heights from the root section and defining the radii of circles tangent connecting adjacent points, the profile of the blade is defined at each radial position and thus the blade profile is defined throughout its entire length.

Table I includes a set of charts defining the nozzle profiles at the indicated fractions of the blade length from the root to the tip radially outwardly of the nozzle blade from the root. Table II includes another similar set of charts for the bucket profiles. Thus, the X,Y and R coordinates given in the charts of Tables I and II at selected radial positions or heights from the root section define the nozzle and bucket profiles, respectively, at each radial position and thus the profiles are defined throughout their entire lengths.

It will be appreciated that having defined the profiles of the nozzle blades and bucket at various selected heights from the respective roots, the over-cambered stage design is defined. The design provides for flow shifting from the root and tip nozzles toward the more efficient mid-portions of the nozzles. Additionally, the buckets accommodate the flow shift and are matched to the nozzle design.

Tables I and II define a specific nozzle blade and specific bucket blade, respectively. The pitch and throat for these nozzle and bucket blades are given in FIGS. 4B and 4C. It will be appreciated that the nozzle blades and buckets having the profiles defined in Tables I and II, respectively, can be scaled up or down to provide dimensionally different nozzle blades and buckets than specified in the Charts yet having the similar profile shapes whereby the improved aerodynamic efficiencies of the present invention are obtained. The scaling up or down can be accomplished by multiplying the X,Y and R coordinates by any predetermined number to achieve the results of the present invention. The pitch may likewise may be scaled upwardly or downwardly by multiplying the pitch by the same number.

To further establish the over-cambered nozzle stage design, the pitch (the spacing between adjacent blades) can be derived from the vane root diameter, e.g., 24 inches and the number of blades around the circumference, e.g., 46. The tangential spacing, for example, at the mid-section (0.5 section of Table I) may be approximated by the expression T=(Root Diameter+2×Radial Height)×(sin Pi/NS) where T is the tangential spacing, Pi is 3.14159, and NS is 46. Thus T=1.9765 inches at mid-span (radial height of 2.4815 inches). All the nozzle sections given were derived from the reduced solidity nozzle base section but linearly scaled in size to maintain the correct spacing-to-size relationship at any given radial height and rotated to obtain the desired blade passage throat opening at that radial height. Therefore, in order to obtain a passage geometry for a typical reduced solidity nozzle, the mid-span section (0.5 section) could be selected as an example. As shown above, the appropriate tangential spacing would be the 1.765 inch value calculated.

TABLE I

| X | (Nozzle Profiles) Y | R |
|---|---|---|
| | 0. SECTION 1 | |
| 0. | 0. | −3.30464 |
| −0.17496 | 0.57862 | −1.66079 |
| −0.31392 | 0.84781 | −1.20129 |
| −0.51951 | 1.09143 | −1.56222 |
| −0.81550 | 1.30279 | −1.21099 |
| −0.88436 | 1.33790 | −10.42423 |
| −1.09574 | 1.43445 | 2.70466 |
| −1.23512 | 1.50106 | 1.12098 |
| −1.32696 | 1.55386 | 0.65304 |
| −1.42452 | 1.63019 | 0.92732 |
| −1.49222 | 1.70159 | 0.13679 |
| −1.48102 | 1.89066 | 0.43487 |
| −1.42915 | 1.93177 | 0.34496 |
| −1.35253 | 1.97063 | 1.47691 |
| −1.15061 | 2.02725 | 0.92020 |
| −0.97940 | 2.04592 | 0.70302 |
| −0.77512 | 2.01875 | 0.65149 |
| −0.42326 | 1.76923 | 1.14947 |
| −0.29732 | 1.54018 | 1.79630 |
| −0.23018 | 1.34497 | 5.50840 |
| −0.09626 | 0.73875 | 32.93630 |
| 0.01476 | 0.00276 | 0.00752 |
| 0. | 0. | |
| | 0.10 SECTION 2 | |
| 0.02355 | 0. | −3.43841 |
| −0.19078 | 0.59209 | −1.72799 |
| −0.35045 | 0.86432 | −1.24998 |
| −0.57809 | 1.10617 | −1.62501 |
| −0.89804 | 1.30924 | −1.26073 |

TABLE I-continued

| X | (Nozzle Profiles) Y | R |
|---|---|---|
| −0.97172 | 1.34186 | −10.74515 |
| −1.19719 | 1.43021 | 2.82611 |
| −1.34605 | 1.49152 | 1.16884 |
| −1.44463 | 1.54115 | 0.68039 |
| −1.55018 | 1.61466 | 0.96074 |
| −1.62501 | 1.68529 | 0.14240 |
| −1.62411 | 1.88252 | 0.45422 |
| −1.57248 | 1.92826 | 0.36032 |
| −1.49478 | 1.97317 | 1.53996 |
| −1.28775 | 2.04365 | 0.95989 |
| −1.11047 | 2.07287 | 0.73322 |
| −0.89565 | 2.05611 | 0.67854 |
| −0.51584 | 1.81658 | 1.19589 |
| −0.37192 | 1.58546 | 1.86856 |
| −0.29181 | 1.38825 | 5.72620 |
| −0.11400 | 0.74818 | 34.06172 |
| 0.03816 | 0.00350 | 0.00752 |
| 0.02355 | 0. | |
| | 0.20 SECTION 3 | |
| 0.04711 | 0. | −3.57613 |
| −0.20305 | 0.60526 | −1.79716 |
| −0.38157 | 0.88070 | −1.30003 |
| −0.62930 | 1.12142 | −1.69001 |
| −0.97106 | 1.31754 | −1.31191 |
| −1.04925 | 1.34806 | −11.17768 |
| −1.28763 | 1.42940 | 2.93878 |
| −1.44514 | 1.48620 | 1.21536 |
| −1.54984 | 1.53318 | 0.70770 |
| −1.66259 | 1.60440 | 0.99444 |
| −1.74399 | 1.67461 | 0.14811 |
| −1.75211 | 1.87958 | 0.47258 |
| −1.70069 | 1.92940 | 0.37495 |
| −1.62195 | 1.97973 | 1.60165 |
| −1.41012 | 2.06256 | 0.99835 |
| −1.22726 | 2.10114 | 0.76261 |
| −1.00347 | 2.09372 | 0.70565 |
| −0.59763 | 1.86251 | 1.24369 |
| −0.43734 | 1.62901 | 1.94322 |
| −0.34414 | 1.42574 | 5.95545 |
| −0.13229 | 0.77538 | 35.47094 |
| 0.06154 | 0.00417 | 0.00752 |
| 0.04711 | 0. | |
| | 0.30 SECTION 4 | |
| 0.07066 | 0. | −3.71346 |
| −0.20878 | 0.61999 | −1.86620 |
| −0.40307 | 0.89999 | −1.35001 |
| −0.66804 | 1.14172 | −1.75513 |
| −1.02911 | 1.33408 | −1.36262 |
| −1.11128 | 1.36321 | −11.62545 |
| −1.36132 | 1.43985 | 3.04943 |
| −1.52665 | 1.49367 | 1.26161 |
| −1.63681 | 1.53901 | 0.73481 |
| −1.75602 | 1.60916 | 1.03120 |
| −1.84293 | 1.67950 | 0.15381 |
| −1.85801 | 1.89198 | 0.49029 |
| −1.80630 | 1.94533 | 0.38931 |
| −1.72623 | 2.00012 | 1.66291 |
| −1.50913 | 2.09298 | 1.03656 |
| −1.32060 | 2.13899 | 0.79180 |
| −1.08845 | 2.13864 | 0.73271 |
| −0.65949 | 1.91196 | 1.29145 |
| −0.48543 | 1.67480 | 2.01789 |
| −0.38202 | 1.46681 | 6.18673 |
| −0.13942 | 0.79379 | 36.87127 |
| 0.08494 | 0.00465 | 0.00752 |
| 0.07066 | 0. | |
| | 0.40 SECTION 5 | |
| 0.09421 | 0. | −3.85101 |
| −0.20632 | 0.63803 | −1.93519 |
| −0.41265 | 0.92500 | −1.39983 |
| −0.69162 | 1.17104 | −1.81961 |
| −1.06937 | 1.36418 | −1.41250 |
| −1.15510 | 1.39295 | −12.01687 |
| −1.41577 | 1.46804 | 3.16645 |
| −1.58815 | 1.52092 | 1.30913 |
| −1.70321 | 1.56599 | 0.76217 |
| −1.82828 | 1.63677 | 1.07238 |
| −1.91942 | 1.70799 | 0.15948 |

TABLE I-continued (Nozzle Profiles)

| X | Y | R |
|---|---|---|
| −1.93881 | 1.92806 | 0.50868 |
| −1.88608 | 1.98433 | 0.40389 |
| −1.80402 | 2.04255 | 1.72481 |
| −1.58045 | 2.14269 | 1.07522 |
| −1.38550 | 2.19375 | 0.82097 |
| −1.14447 | 2.19737 | 0.75981 |
| −0.69616 | 1.96990 | 1.33912 |
| −0.51152 | 1.72699 | 2.09241 |
| −0.40068 | 1.51314 | 6.41550 |
| −0.13581 | 0.81440 | 38.25573 |
| 0.10843 | 0.00484 | 0.00752 |
| 0.09421 | 0. | |
| 0.50 SECTION 6 | | |
| 0.11777 | 0. | −3.98860 |
| −0.19971 | 0.65790 | −2.00422 |
| −0.41620 | 0.95312 | −1.44976 |
| −0.70753 | 1.20522 | −1.88438 |
| −1.10074 | 1.40159 | −1.46307 |
| −1.18980 | 1.43054 | −12.43137 |
| −1.46050 | 1.50573 | 3.28073 |
| −1.63958 | 1.55881 | 1.35607 |
| −1.75920 | 1.60435 | 0.78949 |
| −1.88936 | 1.67637 | 1.10946 |
| −1.98453 | 1.74929 | 0.16516 |
| −2.00671 | 1.97706 | 0.52783 |
| −1.95274 | 2.03575 | 0.41849 |
| −1.86823 | 2.09693 | 1.78692 |
| −1.63766 | 2.20284 | 1.11388 |
| −1.43639 | 2.25762 | 0.85075 |
| −1.18719 | 2.26384 | 0.78694 |
| −0.72004 | 2.03260 | 1.38683 |
| −0.52641 | 1.78280 | 2.16682 |
| −0.40951 | 1.56236 | 6.64473 |
| −0.12686 | 0.83651 | 39.63547 |
| 0.13194 | 0.00497 | 0.00752 |
| 0.11777 | 0. | |
| 0.60 SECTION 7 | | |
| 0.14132 | 0 | −4.12685 |
| −0.18836 | 0.68005 | −2.07395 |
| −0.41285 | 0.98503 | −1.50040 |
| −0.71468 | 1.24532 | −1.95084 |
| −1.12155 | 1.44776 | −1.51559 |
| −1.21392 | 1.47764 | −12.96951 |
| −1.49401 | 1.55505 | 3.38357 |
| −1.67930 | 1.60974 | 1.40061 |
| −1.80300 | 1.65670 | 0.81642 |
| −1.93705 | 1.73063 | 1.13914 |
| −2.03631 | 1.80649 | 0.17097 |
| −2.05940 | 2.04217 | 0.54537 |
| −2.00384 | 2.10276 | 0.43268 |
| −1.91648 | 2.16619 | 1.84780 |
| −1.67831 | 2.27598 | 1.15165 |
| −1.47044 | 2.33289 | 0.87987 |
| −1.21367 | 2.33982 | 0.81416 |
| −0.72923 | 2.10135 | 1.43513 |
| −0.52841 | 1.84320 | 2.24226 |
| −0.40706 | 1.61532 | 6.87880 |
| −0.11172 | 0.86003 | 41.12657 |
| 0.15547 | 0.00504 | 0.00752 |
| 0.14132 | 0. | |
| 0.70 SECTION 8 | | |
| 0.16487 | 0. | −4.26341 |
| −0.16262 | 0.70888 | −2.14210 |
| −0.38870 | 1.02827 | −1.54951 |
| −0.69555 | 1.30293 | −2.01377 |
| −1.11208 | 1.51975 | −1.56510 |
| −1.20702 | 1.55238 | −13.27566 |
| −1.49504 | 1.63758 | 3.50747 |
| −1.68553 | 1.69750 | 1.44917 |
| −1.81249 | 1.74828 | 0.84412 |
| −1.94947 | 1.82695 | 1.17475 |
| −2.05084 | 1.90726 | 0.17654 |
| −2.07025 | 2.15116 | 0.56507 |
| −2.01172 | 2.21268 | 0.44784 |
| −1.92013 | 2.27669 | 1.91045 |
| −1.67184 | 2.38575 | 1.19103 |
| −1.45579 | 2.44071 | 0.90967 |
| −1.19025 | 2.44307 | 0.84115 |

TABLE I-continued (Nozzle Profiles)

| X | Y | R |
|---|---|---|
| −0.69415 | 2.18756 | 1.48195 |
| −0.49161 | 1.91707 | 2.31528 |
| −0.37063 | 1.67941 | 7.10403 |
| −0.07835 | 0.88810 | 42.53011 |
| 0.17912 | 0.00476 | 0.00752 |
| 0.16487 | 0. | |
| 0.81 SECTION 9 | | |
| 0.18843 | 0. | −4.40188 |
| −0.12634 | 0.74215 | −2.21199 |
| −0.34914 | 1.07906 | −1.60036 |
| −0.65671 | 1.37250 | −2.08077 |
| −1.07911 | 1.60988 | −1.61834 |
| −1.17618 | 1.64677 | −13.85315 |
| −1.47045 | 1.74426 | 3.60626 |
| −1.66495 | 1.81247 | 1.49286 |
| −1.79412 | 1.86909 | 0.87103 |
| −1.93197 | 1.95428 | 1.20217 |
| −2.03472 | 2.04128 | 0.18239 |
| −2.04634 | 2.29372 | 0.58335 |
| −1.98422 | 2.35491 | 0.46179 |
| −1.88760 | 2.41791 | 1.97153 |
| −1.62811 | 2.52205 | 1.22875 |
| −1.40404 | 2.57149 | 0.93923 |
| −1.13222 | 2.56562 | 0.86858 |
| −0.62638 | 2.28526 | 1.53043 |
| −0.42626 | 1.99951 | 2.39093 |
| −0.30916 | 1.75018 | 7.33921 |
| −0.03245 | 0.92019 | 44.06648 |
| 0.20285 | 0.00419 | 0.00752 |
| 0.18843 | 0. | |
| 0.91 SECTION 10 | | |
| 0.21198 | 0. | −4.53983 |
| −0.06665 | 0.78329 | −2.28156 |
| −0.27535 | 1.14372 | −1.65074 |
| −0.57395 | 1.46461 | −2.14680 |
| −0.99410 | 1.73485 | −1.66921 |
| −1.09177 | 1.77881 | −14.35812 |
| −1.38857 | 1.89724 | 3.71207 |
| −1.58452 | 1.97942 | 1.53814 |
| −1.71392 | 2.04565 | 0.89786 |
| −1.85006 | 2.14144 | 1.23598 |
| −1.95097 | 2.23779 | 0.18825 |
| −1.94735 | 2.49847 | 0.59744 |
| −1.87950 | 2.55776 | 0.47568 |
| −1.77658 | 2.61641 | 2.03127 |
| −1.50313 | 2.70765 | 1.26615 |
| −1.27010 | 2.74472 | 0.96801 |
| −0.99180 | 2.72230 | 0.89621 |
| −0.48670 | 2.40215 | 1.57880 |
| −0.29836 | 2.09589 | 2.46687 |
| −0.19314 | 1.83216 | 7.57059 |
| 0.04271 | 0.95210 | 47.68283 |
| 0.22659 | 0.00348 | 0.00752 |
| 0.21198 | 0 | |
| 1.01 SECTION 11 | | |
| 0.23553 | 0. | −4.64978 |
| 0.01761 | 0.82806 | −2.33678 |
| −0.16582 | 1.21615 | −1.69106 |
| −0.44560 | 1.57107 | −2.19753 |
| −0.85608 | 1.88409 | −1.70655 |
| −0.95192 | 1.93666 | −14.06973 |
| −1.24788 | 2.08255 | 3.88627 |
| −1.44297 | 2.18275 | 1.59551 |
| −1.57113 | 2.26129 | 0.92503 |
| −1.70608 | 2.37307 | 1.30776 |
| −1.79924 | 2.47701 | 0.19337 |
| −1.77475 | 2.74440 | 0.62148 |
| −1.69879 | 2.80069 | 0.49396 |
| −1.58815 | 2.85246 | 2.10306 |
| −1.29775 | 2.92430 | 1.31364 |
| −1.05383 | 2.94339 | 1.00339 |
| −0.76251 | 2.89548 | 0.92356 |
| −0.27383 | 2.52510 | 1.61727 |
| −0.10680 | 2.19546 | 2.52519 |
| −0.02036 | 1.91175 | 7.71353 |
| 0.12173 | 1.16891 | 45.83996 |
| 0.25035 | 0.00243 | 0.00752 |

TABLE I-continued

| (Nozzle Profiles) | | |
|---|---|---|
| X | Y | R |
| 0.23553 | 0. | |

TABLE II

| (Bucket Profiles) | | |
|---|---|---|
| X | Y | R |
| 0. SECTION 1 | | |
| 0.83983 | −0.88225 | −1.59829 |
| 0.52333 | −0.35666 | −0.90121 |
| 0.25648 | −0.15432 | −0.53423 |
| 0.00803 | −0.09845 | −0.83139 |
| −0.33396 | −0.17939 | −1.25072 |
| −0.53106 | −0.29679 | −1.01829 |
| −0.78594 | −0.56558 | 0.13360 |
| −0.82054 | −0.60168 | 0.02551 |
| −0.86083 | −0.58025 | 0.13360 |
| −0.85433 | −0.54231 | 4.14172 |
| −0.71498 | −0.17398 | 1.82587 |
| −0.51349 | 0.17756 | 0.90728 |
| −0.31551 | 0.37514 | 0.57780 |
| −0.02204 | 0.48405 | 0.45531 |
| 0.30882 | 0.37789 | 0.90205 |
| 0.53934 | 0.07994 | 4.36853 |
| 0.86858 | −0.87390 | 0.01500 |
| 0.83983 | −0.88225 | |
| 0.10 SECTION 2 | | |
| 0.81290 | −0.89899 | −1.69049 |
| 0.56736 | −0.45305 | −1.01353 |
| 0.27119 | −0.19295 | −0.73237 |
| 0.10318 | −0.12190 | −0.78415 |
| −0.08333 | −0.09284 | −0.84322 |
| −0.70064 | −0.33465 | 0.74338 |
| −0.74988 | −0.37846 | 0.03454 |
| −0.80518 | −0.34303 | 0.93607 |
| −0.76237 | −0.21655 | 1.74394 |
| −0.64955 | 0.00624 | 1.23665 |
| −0.42209 | 0.28405 | 0.68442 |
| −0.19334 | 0.42198 | 0.59246 |
| −0.03642 | 0.45549 | 0.34729 |
| 0.08577 | 0.44283 | 0.42531 |
| 0.26096 | 0.34235 | 1.21136 |
| 0.47239 | 0.07501 | 2.31612 |
| 0.60609 | −0.19257 | 5.07508 |
| 0.76005 | −0.60772 | 4.84048 |
| 0.84150 | −0.89010 | 0.01500 |
| 0.81290 | −0.89899 | |
| 0.20 SECTION 3 | | |
| 0.78249 | −0.92030 | −1.88282 |
| 0.69284 | −0.71485 | −1.59410 |
| 0.58754 | −0.53750 | −1.13126 |
| 0.06967 | −0.12454 | −0.85000 |
| −0.41665 | −0.08318 | −0.64972 |
| −0.54650 | −0.12500 | −1.13217 |
| −0.66479 | −0.18591 | 0.44889 |
| −0.69683 | −0.20316 | 0.04346 |
| −0.75667 | −0.14915 | 0.82232 |
| −0.66128 | 0.03524 | 1.01807 |
| −0.47834 | 0.23641 | 0.97655 |
| −0.18824 | 0.40492 | 0.33264 |
| 0.00727 | 0.41566 | 0.44882 |
| 0.18648 | 0.32470 | 1.17259 |
| 0.40465 | 0.08401 | 1.42620 |
| 0.51608 | −0.11130 | 5.02245 |
| 0.67945 | −0.50038 | 4.76520 |
| 0.81104 | −0.91120 | 0.01500 |
| 0.78249 | −0.92030 | |
| 0.30 SECTION 4 | | |
| 0.74447 | −0.94460 | −1.64360 |
| 0.40797 | −0.38776 | −1.20000 |
| −0.17117 | −0.03873 | −0.65000 |
| −0.56476 | −0.05892 | 29.22309 |
| −0.64061 | −0.08728 | 0.25621 |
| −0.66007 | −0.09365 | 0.04893 |
| −0.71910 | −0.02902 | 0.25621 |
| −0.70822 | −0.00460 | 0.87543 |
| −0.57385 | 0.18909 | 0.65701 |

TABLE II-continued

| (Bucket Profiles) | | |
|---|---|---|
| X | Y | R |
| −0.37772 | 0.33567 | 0.62278 |
| −0.13524 | 0.39810 | 0.37475 |
| 0.05461 | 0.35712 | 0.53050 |
| 0.20744 | 0.23907 | 1.81860 |
| 0.41855 | −0.04953 | 2.22704 |
| 0.53117 | −0.26685 | 4.80028 |
| 0.66636 | −0.59980 | 4.46566 |
| 0.72472 | −0.77132 | 3.99061 |
| 0.77307 | −0.93561 | 0.01500 |
| 0.74447 | −0.94460 | |
| 0.40 SECTION 5 | | |
| 0.70713 | −0.97503 | −1.70298 |
| 0.21431 | −0.25308 | −1.64497 |
| −0.02850 | −0.08021 | −0.84946 |
| −0.22565 | 0.00351 | −0.78404 |
| −0.40397 | 0.03223 | −0.52893 |
| −0.55163 | 0.01795 | 4.03674 |
| −0.62129 | 0.00177 | 0.05695 |
| −0.68304 | 0.08575 | 0.77220 |
| −0.56301 | 0.24339 | 0.54500 |
| −0.40999 | 0.35222 | 0.51640 |
| −0.19454 | 0.40248 | 0.42515 |
| 0.00114 | 0.35769 | 0.49709 |
| 0.10854 | 0.28514 | 0.72393 |
| 0.21375 | 0.16939 | 2.81090 |
| 0.48136 | −0.28097 | 4.19106 |
| 0.73574 | −0.96607 | 0.01500 |
| 0.70713 | −0.97503 | |
| 0.50 SECTION 6 | | |
| 0.67046 | −1.01159 | −1.90205 |
| 0.41186 | −0.52051 | −2.24730 |
| 0.03236 | −0.11697 | −0.95808 |
| −0.33663 | 0.07249 | −0.54910 |
| −0.56162 | 0.08365 | 0.32725 |
| −0.59893 | 0.07992 | 0.06250 |
| −0.65255 | 0.17854 | 0.74814 |
| −0.57410 | 0.27188 | 0.51501 |
| −0.42621 | 0.37608 | 0.45189 |
| −0.14137 | 0.40879 | 0.34470 |
| −0.02267 | 0.35914 | 0.75815 |
| 0.20087 | 0.13067 | 4.20000 |
| 0.69909 | −1.00270 | 0.01500 |
| 0.67046 | −1.01159 | |
| 0.60 SECTION 7 | | |
| 0.63759 | −1.06002 | −2.55845 |
| 0.06584 | −0.15512 | −1.13442 |
| −0.14289 | 0.01352 | −0.98881 |
| −0.37019 | 0.11887 | −0.70733 |
| −0.49873 | 0.14679 | −0.84938 |
| −0.57936 | 0.15270 | 0.06441 |
| −0.62493 | 0.26092 | 0.59623 |
| −0.50733 | 0.35866 | 0.44517 |
| −0.35452 | 0.41962 | 0.42851 |
| −0.01117 | 0.34026 | 0.66235 |
| 0.09103 | 0.24301 | 1.07599 |
| 0.19548 | 0.09666 | 3.45921 |
| 0.38036 | −0.26015 | 5.76660 |
| 0.57038 | −0.74296 | 5.94735 |
| 0.62284 | −0.90355 | 4.91384 |
| 0.66614 | −1.05083 | 0.01501 |
| 0.63759 | −1.06002 | |
| 0.70 SECTION 8 | | |
| 0.60445 | −1.10816 | −3.19857 |
| 0.08442 | −0.18625 | −1.24310 |
| −0.19180 | 0.06621 | −1.04724 |
| −0.50476 | 0.20772 | −0.89328 |
| −0.57066 | 0.22261 | 0.06567 |
| −0.60111 | 0.33726 | 0.49842 |
| −0.45460 | 0.42341 | 0.43596 |
| −0.26583 | 0.45007 | 0.42510 |
| −0.11847 | 0.41080 | 0.49099 |
| 0.01601 | 0.31711 | 0.75499 |
| 0.09685 | 0.22355 | 1.11485 |
| 0.17707 | 0.09651 | 4.09510 |
| 0.40135 | −0.39248 | 7.83098 |
| 0.63301 | −1.09906 | 0.01500 |
| 0.60445 | −1.10816 | |

TABLE II-continued

| X | (Bucket Profiles) Y | R |
|---|---|---|
| | 0.80 SECTION 9 | |
| 0.57105 | −1.15601 | −3.75617 |
| 0.07696 | −0.18641 | −1.34925 |
| −0.11023 | 0.02602 | −1.15355 |
| −0.32183 | 0.18019 | −1.29452 |
| −0.44449 | 0.24141 | −2.24258 |
| −0.56754 | 0.29062 | 0.06560 |
| −0.58105 | 0.40702 | 0.46009 |
| −0.18596 | 0.46028 | 0.45745 |
| −0.08347 | 0.41152 | 0.48742 |
| 0.00697 | 0.33705 | 0.76645 |
| 0.08766 | 0.23672 | 1.00229 |
| 0.16078 | 0.10894 | 5.04181 |
| 0.29988 | −0.20955 | 6.27645 |
| 0.43294 | −0.57857 | 10.04186 |
| 0.59977 | −1.14741 | 0.01500 |
| 0.57105 | −1.15601 | |
| | 0.90 SECTION 10 | |
| 0.53738 | −1.20356 | −4.04446 |
| 0.06907 | −0.18248 | −1.74644 |
| −0.09770 | 0.03718 | −0.97940 |
| −0.25067 | 0.17595 | −1.09099 |
| −0.34974 | 0.24042 | −3.30110 |
| −0.53100 | 0.33748 | 2.74368 |
| −0.56610 | 0.35520 | 0.06435 |
| −0.56543 | 0.47002 | 0.46328 |
| −0.29655 | 0.51456 | 0.49882 |
| −0.00643 | 0.36875 | 0.64143 |
| 0.07294 | 0.26945 | 0.93258 |
| 0.14545 | 0.13442 | 4.98521 |
| 0.23341 | −0.08132 | 7.17428 |
| 0.32775 | −0.34440 | 7.72783 |
| 0.44501 | −0.72469 | 11.44510 |
| 0.56635 | −1.19583 | 0.01500 |
| 0.53738 | −1.20356 | |
| | 1.00 SECTION 11 | |
| 0.50345 | −1.25083 | −4.00000 |
| 0.01585 | −0.10075 | −2.56784 |
| −0.08043 | 0.04261 | −0.86369 |
| −0.28288 | 0.24292 | −1.55701 |
| −0.37938 | 0.30580 | −4.16565 |
| −0.44462 | 0.34414 | 0. |
| −0.52333 | 0.38945 | 2.42949 |
| −0.56538 | 0.41422 | 0.06250 |
| −0.55610 | 0.52587 | 0.32725 |
| −0.53135 | 0.53453 | 0.49139 |
| −0.26667 | 0.54079 | 0.54212 |
| −0.01953 | 0.40127 | 0.65047 |
| 0.13284 | 0.16610 | 9.00000 |

TABLE II-continued

| X | (Bucket Profiles) Y | R |
|---|---|---|
| 0.53273 | −1.24430 | 0.01500 |
| 0.50345 | −1.25083 | |

While the invention has been described with respect to what is presently regarded as the most practical embodiments thereof, it will be understood by those of ordinary skill in the art that various alterations and modifications may be made which nevertheless remain within the scope of the invention as defined by the claims which follow.

We claim:

1. A nozzle for a steam turbine having a pair of adjacent blades having leading and trailing edges, blade bodies therebetween, and root and tip portions with a mid-region therebetween, said adjacent blades defining a throat therebetween measured by a series of straight lines extending from the trailing edges of a blade to the closest adjacent surface along the body of the adjacent blade and defining a pitch in the circumferential spacing between blades, the ratios of the throat to the pitch at successive profiles along said blades increasing from the root portions toward a mid-blade region and then decreasing from the mid-blade region to the tip portion, the blades being one of nozzle or bucket blades.

2. A nozzle for a steam turbine having a blade profile in accordance with Table I.

3. A stage for a steam turbine having a plurality of nozzles each having a blade profile according to claim 2 and a plurality of buckets each having a bucket profile in accordance with Table II.

4. A nozzle for a steam turbine having nozzle blade profiles in accordance with Table I scaled by multiplying X,Y and R coordinates thereof by a predetermined number.

5. A stage for a steam turbine having a plurality of nozzles each having a blade profile according to claim 4 and a plurality of buckets each having a bucket profile in accordance with Table II scaled by multiplying X,Y and R coordinates thereof by said predetermined number.

6. A bucket for a steam turbine having a bucket profile in accordance with Table II.

7. A bucket for a steam turbine having a bucket profile in accordance with Table II scaled by multiplying X,Y and R coordinates thereof by a predetermined number. blades being one of nozzle or bucket blades.

* * * * *